United States Patent [19]

Griffith

[11] Patent Number: 4,494,667

[45] Date of Patent: Jan. 22, 1985

[54] LENS TRAY

[75] Inventor: John M. Griffith, Richmond, Va.

[73] Assignee: Coburn Optical Industries, Inc., Muskogee, Okla.

[21] Appl. No.: 478,174

[22] Filed: Mar. 23, 1983

[51] Int. Cl.[3] ..... A45F 3/14; B65D 21/00

[52] U.S. Cl. ..... 220/19; 206/509; 206/510; 206/564

[58] Field of Search ..... 220/19; 206/509, 510, 206/512, 513, 558, 564, 565

[56] References Cited

U.S. PATENT DOCUMENTS

| | | | |
|---|---|---|---|
| 2,223,554 | 12/1940 | Davis | 206/510 |
| 3,191,791 | 6/1965 | Jackson | 217/25.5 |
| 3,469,686 | 9/1969 | Gutsche et al. | 206/65 |
| 3,489,124 | 1/1970 | Cannon | 206/509 X |
| 3,559,836 | 2/1971 | Pink | 220/19 |
| 3,591,032 | 7/1971 | Baxter | 206/564 X |
| 3,672,495 | 6/1972 | Bauer et al. | 220/4 R X |
| 3,857,480 | 12/1974 | McClernon | 206/5.1 |
| 4,079,836 | 3/1978 | Von Stein et al. | 206/510 X |
| 4,122,942 | 10/1978 | Wolfson | 206/5.1 |

*Primary Examiner*—Steven M. Pollard

[57] ABSTRACT

A lens tray for holding optical lenses aligned horizontally in a lateral array wherein the tray is capable of holding lenses in such manner that the active surfaces of the lenses do not contact any foreign surface that may mar or scratch the active surfaces.

5 Claims, 6 Drawing Figures

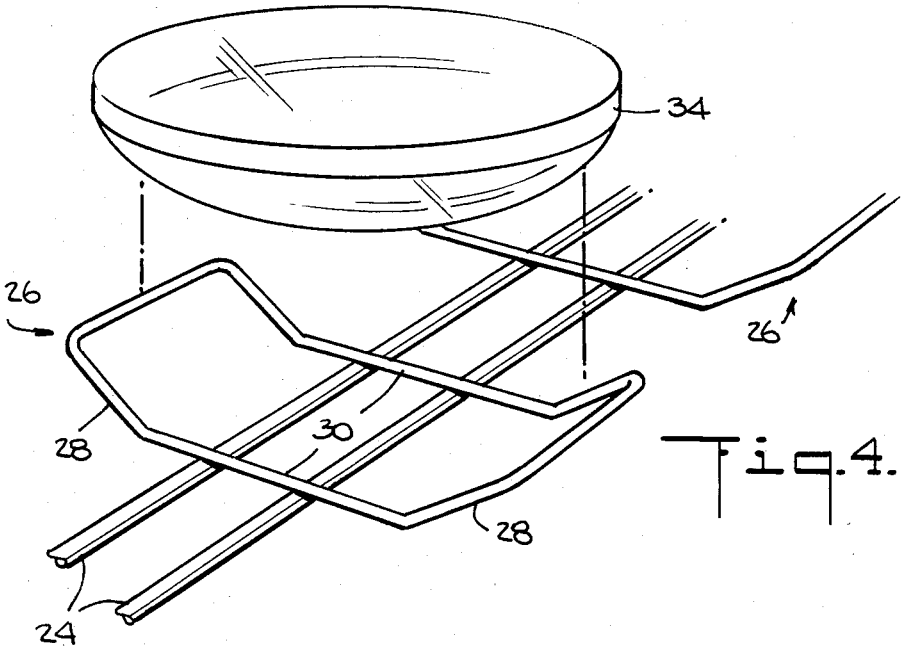
Fig. 4.
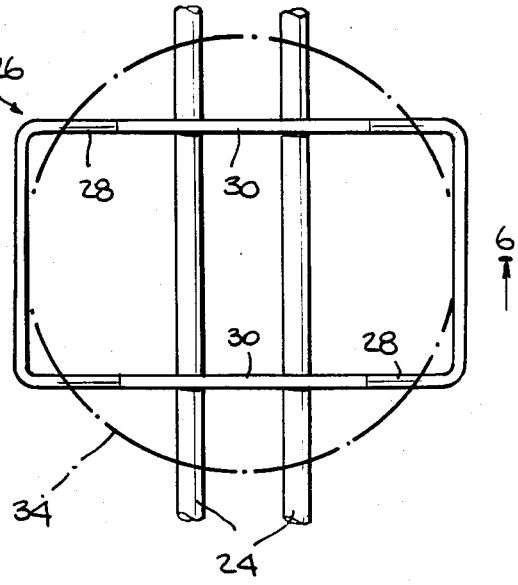
Fig. 5.
Fig. 6.
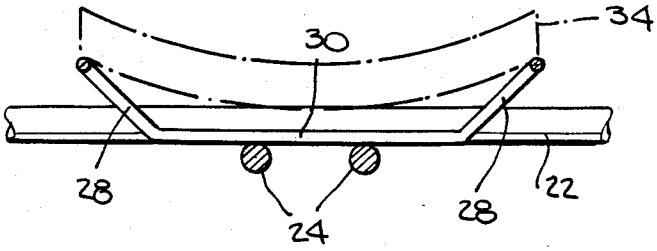

LENS TRAY

BACKGROUND OF THE INVENTION

This invention relates to a rack or tray for holding lenses, such as ophthalmic and sunglass lenses.

Ophthalmic and sunglass lenses have been used for many years. The optical industry has faced difficult problems in the manufacturing, handling and packaging of the optical glass materials. Such glasses are sensitive to mechanical stress, scratch easily and require the utmost care in handling to insure that a safe precision product is provided to the user. More recently the problems associated with manufacturing handling and packaging of ophthalmic lenses became more difficult because of the use of composite materials for ophthalmic applications, namely, glass-plastic laminates. Generally, such composites are made of at least two materials: an inorganic glass lens prefinished by grinding and polishing to prescription on both of its major surfaces, and a composite organic material in the form of a thin film bonded to the glass lens and forming therewith the "uncut" form of the ophthalmic lens. If desired, the uncut lens is then tinted to various colors to provide luminous transmission characteristics thereto. For mounting, the completed lens is edge finished and installed in frames by conventional methods. The process for making such composite lenses generally includes the cleaning, drying and inspection of the inorganic glass surface, the positioning of the organic film material onto the glass lens, the lamination of the two components, dying or tinting the composite, and "fixing" the dye thereto.

In the above-described process the necessity of safe and convenient handling of the optical material should be apparent to those skilled in the optical art. Specifically, the highly polished active surfaces of the lens must remain free from contact with any hard foreign surface whatsoever during the manufacturing, handling and storage thereof. It has been found that when the active surfaces contact any hard substance the surface tends to become marred making subsequent processing steps futile or in the finished product resulting in impaired efficacy of transmission of light therethrough.

Accordingly, it is an important object of the present invention to provide a rack or tray for processing, handling or storing optical lenses.

It is another object of the present invention to provide a rack or tray which is capable of holding optical lenses in such manner that the active or critical surfaces of the lenses do not contact any foreign surface that may mar or scratch the active surfaces.

It is still another object of the present invention to provide a series of nestable racks or trays which are capable of being stacked on one another without contacting the active surfaces of the lenses held therein.

SUMMARY OF THE INVENTION

The objects of the present invention are accomplished in a wire rack or tray for holding lenses aligned horizontally in a lateral array comprising:

a rectangular frame having front, back and side portions;

parallel supporting pairs of bars spaced from each other and extending transversly between the side portions of the rectangular frame;

a plurality of lens support members supported by said pairs of bars, said lens support members being generally of rectangular shape having a flat bottom and inclined sickle shape end portions, said portions being inclined at about 45° from the horizon for holding the edges of the outer convex surface of the lenses;

a pair of handles for carrying the rack or tray positioned on each of said side portions of the rectangular frame forming an angle of about 99° with said frame;

a pair of upwardly pointing tray support fingers positioned on the inside handles to receive and hold the rectangular frame of another rack or tray when the same are stacked upon each other.

The novel construction of the present invention provides for holding lenses on their edges only in four different places while the lenses are aligned horizontally in a lateral array. By such a construction the functional or active surfaces of the lenses are not touched by any part of the tray.

It is to be understood that while the rack or tray is preferably made of steel wire, other materials, such as hard plastics and alloys are also suitable as materials of construction. Further, if desired, a combination of construction materials can be used, such as coating the wire tray with a suitable thermoplastic film or reinforcing a plastic tray with metal wires. Such variations are within the purview of the invention.

The invention is illustrated in connection with a preferred embodiment illustrated in the accompanying drawings that follow.

BRIEF DESCRIPTION OF THE DRAWINGS

FIG. 4 is a fragmentary perspective view taken from above and looking at a single lens holder which is to receive the lens.

FIG. 5 is a top view of a single lens holder holding a lens.

FIG. 6 is a sectional view taken along line 6—6 of FIG. 5.

DETAILED DESCRIPTION OF THE INVENTION

Figure 1:
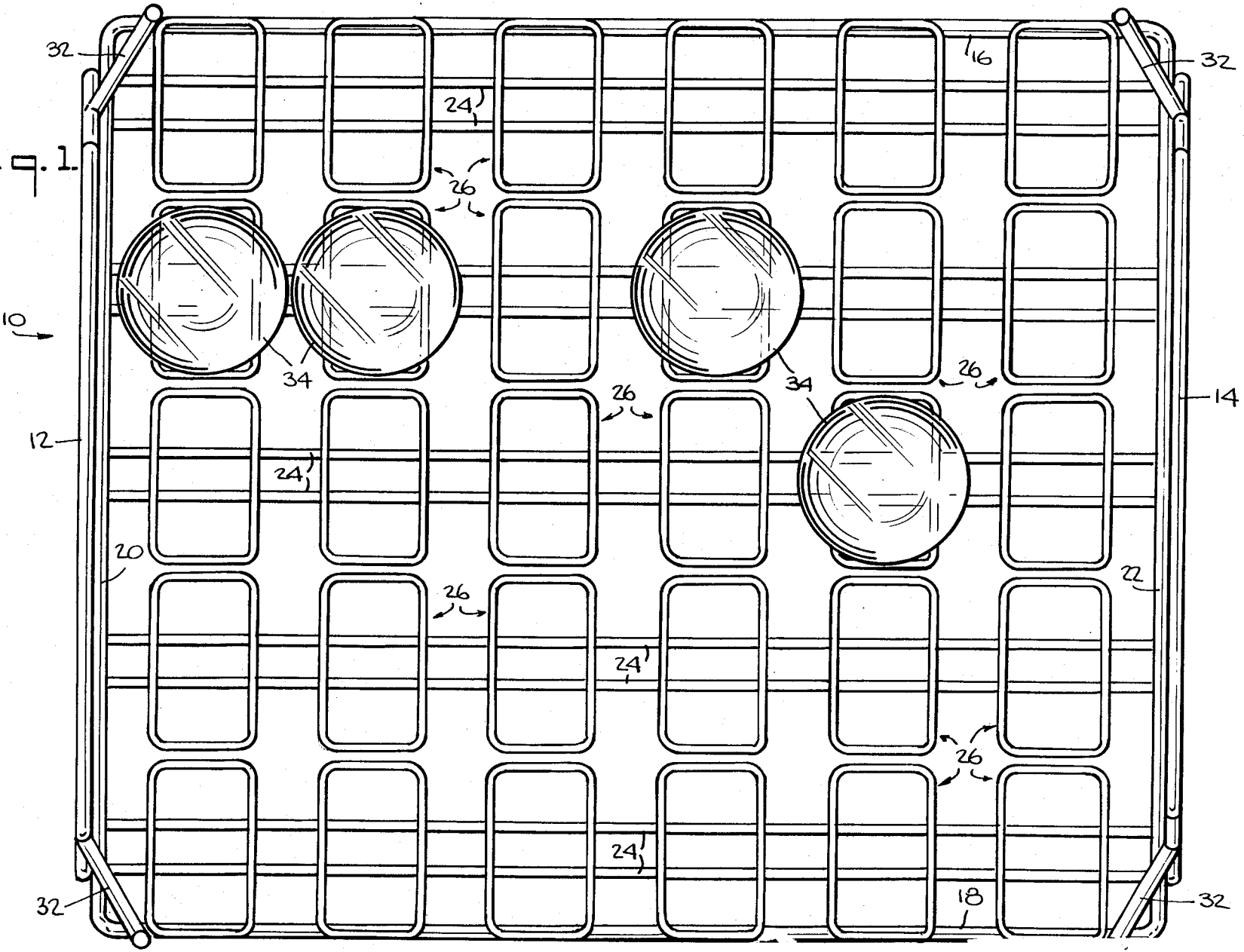
FIG. 1 is a top view of the lens tray.
Figure 2:
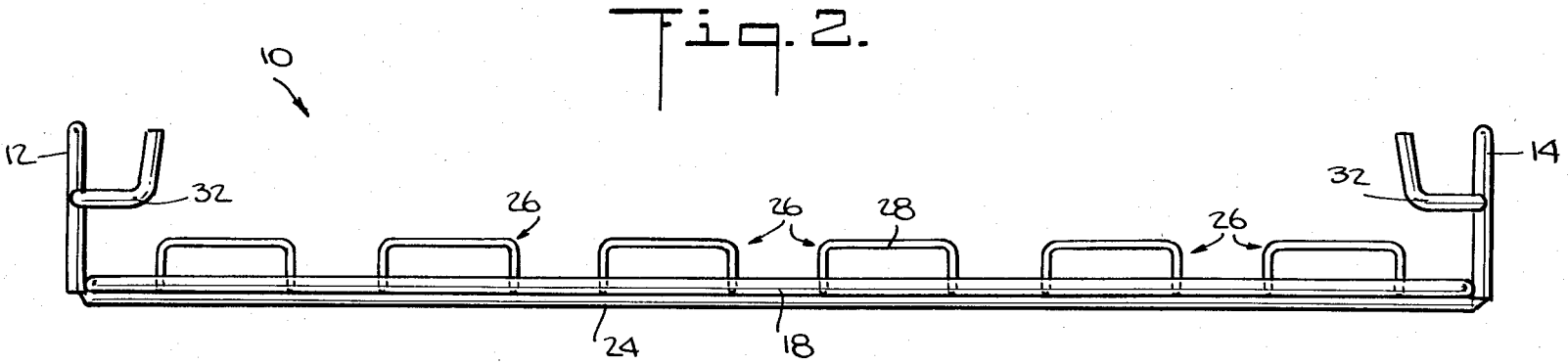
FIG. 2 is a side view of the lens tray.
Figure 3:
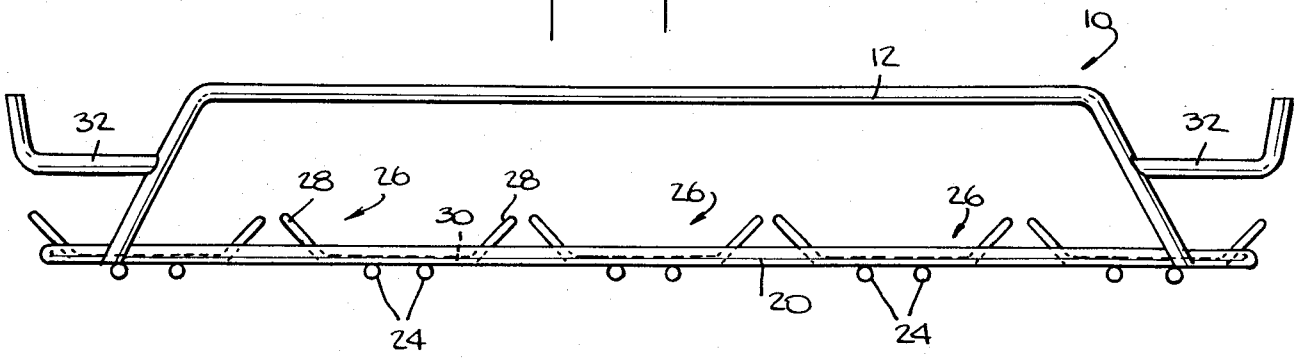
FIG. 3 is a front view of the lens tray.

FIG. 1 shows the lens tray 10 constructed of steel wire or other suitable material, such as various metal alloys or polymeric materials. The lens tray 10 comprises a rectangular frame having front portions 18, back portion 16 and side portions 20 and 22. Extending transversly from and joined with said side portions 20 and 22 a plurality of supporting pairs of bars 24 spaced from each other hold a plurality of lens support members 26 as shown in FIG. 1, 2, 3 and 4. Lens support members 26 being generally of rectangular shape having a horizontal bottom 30, as shown in FIGS. 4 and 6, and inclined, sickle-shape end portions 28 as shown in FIG. 4. The angle of incline is about 45° from the horizon, however, it may be a few degrees less or higher. This configuration insures that the lens placed on the lens support member is held in position but without the active surface of the lens touching the support member. Lens 34, as shown in FIGS. 1, 4, 5 and 6 rests on lens support member in such a way that only the lens' edges touch the lens support member. While lens 34 is preferably placed with portions of its convex surface touching lens support member 26, as shown in FIG. 4, the lens may also be placed on the lens support member up-side down so that its concave surface faces the lens support member. Handles 12 and 14 on the respective sides of the tray 10 is attached to the side portions 20 and 22 of the rectangular frame for easy carrying and handling tray 10. Said handles 12 and 14 are generally perpendicular to frames 16, 18, 20 and 22, however, it is preferred that said handles form about a 99° angle with said frame so that a plurality of trays having the same measurements and configurations may be stacked on one another. To facilitate stacking of the trays of the present invention on top of one another, a pair of upward pointing tray support fingers 32 positioned on the inside of handles 12 and 14 are provided. Tray support fingers 32 receive and hold rectangular frame 16, 18, 20 and 22 above the plurality of lens support members 26 in such manner that the lenses carried by the respective trays will not contact one another when trays are stacked on top of one another.

As previously indicated, the lens tray of the present invention may be made of various materials. It is, however, preferred to construct the same from steel wire of suitable strength and rigidity. In general, steel wires having a diameter of about $\theta''$ is preferred for use for making the frame and handle, 3/16" for making the bars and tray support fingers and 3/36" for making the lens support members. The various parts of the lens tray may be joined together by welding or other suitable means. It is within the experience of one skilled in the art to make the proper modifications when the lens tray is to be made of other material.

While a preferred embodiment of the invention has been illustrated and described, it should be clear that modifications may be made thereto without departing from the principle and spirit of the invention.

What is claimed is:

1. A lens tray for holding lenses aligned horizontally in a lateral array comprising:

a rectangular frame having front, back and side portions;

parallel supporting pairs of bars spaced from each other and extending transversely between said side portions of the rectangular frame;

a plurality of lens support members supported by said pairs of bars for holding lenses thereon, said lens support members being generally of rectangular shape having a flat bottom and inclined sickle shape end portions, said portions being inclined at about 45° from the horizon for holding the edges of the outer convex surface of the lenses;

a pair of handles for carrying the tray positioned on each of said side portions of the rectangular frame forming an angle of about 99° with said frame; and a pair of upwardly pointing tray support fingers positioned on the inside of said handles to receive and hold the rectangular frame of another tray when trays are stacked upon each other.

2. The lens tray of claim 1 wherein said lenses are supported on their edges while being aligned horizontally in a lateral array.

3. The lens tray of claim 1 made of steel wire.

4. The lens tray of claim 1 made of alloys.

5. The lens tray of claim 1 made of polymeric materials.

* * * * *